US005442824A

United States Patent [19]

Kim et al.

[11] Patent Number: 5,442,824

[45] Date of Patent: Aug. 22, 1995

[54] APPARATUS FOR AND METHOD OF CONTROLLING WATER FLOW IN WASHER

[75] Inventors: Jung H. Kim, Seoul; Hyung S. Kim, Kyungki; Byeong H. Lee, Kyungki; Young H. Roh, Kyungki; Hae Y. Chung, Seoul, all of Rep. of Korea

[73] Assignee: Goldstar Co., Ltd., Rep. of Korea

[21] Appl. No.: 136,976

[22] Filed: Oct. 14, 1993

[30] Foreign Application Priority Data

Jun. 19, 1993 [KR] Rep. of Korea ..... 11232/1993

[51] Int. Cl.[6] ..... D06F 33/04

[52] U.S. Cl. ..... 8/159; 68/12.02

[58] Field of Search ..... 68/12.02, 12.16, 12.17; 134/560, 570, 580; 8/159, 158

[56] References Cited

U.S. PATENT DOCUMENTS

| | | | |
|---|---|---|---|
| 5,074,003 | 12/1991 | Manson et al. | 8/159 |
| 5,140,842 | 8/1992 | Kiuchi et al. | 68/12.02 |
| 5,220,814 | 6/1993 | Imai et al. | 68/12.02 |
| 5,230,227 | 7/1993 | Kondoh et al. | 68/12.02 |
| 5,241,845 | 9/1993 | Ishibashi et al. | 68/12.16 |
| 5,297,307 | 3/1994 | Baek | 8/159 |

FOREIGN PATENT DOCUMENTS

| | | | |
|---|---|---|---|
| 3-94796 | 4/1994 | Japan | 68/12.02 |

*Primary Examiner*—Frankie L. Stinson

*Attorney, Agent, or Firm*—Ostrolenk, Faber, Gerb & Soffen

[57] ABSTRACT

An apparatus for and a method of controlling a water flow in a washer, capable of generating drive patterns for an agitator by utilizing a branching phenomenon occurring in solutions of a function having one parameter. The method comprises the first step of determining the number of times (N) operating solutions of a function having one parameter until solutions periodically repeated are obtained from the function, an initial value of the function, a parameter of the function determined according to a selected operation mode, the total number of solutions of the function, and the number of times (I) executing drive patterns for a predetermined washing operation time, the second step of inputting the initial value as a variable of the function, inputting the parameter, deriving a solution of the function, based on the inputted initial value and parameter, inputting the solution as the variable of the function,.and repeatedly executing the above operation procedure of this step for the number of times (N), the third step of executing the operation procedure of the second step again, generating a driving pattern, and then repeatedly executing the above procedure of this step for the predetermined total number of solutions, and the fourth step of repeatedly executing the above procedures following the first step for the number of times (I).

4 Claims, 5 Drawing Sheets

APPARATUS FOR AND METHOD OF CONTROLLING WATER FLOW IN WASHER

BACKGROUND OF THE INVENTION

1. Field of the Invention

The present invention relates to washers, and more particularly to an apparatus for and a method of controlling a water flow for reducing twist of clothes being washed in a washer.

2. Description of the Prior Art

In conventional washers, an agitator rotates with a constant rotation force and in a normal direction or a reverse direction in accordance with a drive pattern. The agitator generates a water flow while rotating. By the water flow, clothes being rotated in a washing tub are struck against the agitator. Thus washing of the clothes is achieved.

In such conventional washers, however, the agitator is usually driven according to a constant drive pattern. As a result, upper clothes and lower clothes in the washing tub are hardly agitated with each other when the amount of the clothes is large. This results in a considerable decrease in washing degree of the upper clothes and a considerable twist of the clothes.

SUMMARY OF THE INVENTION

Therefore, an object of the invention is to provide an apparatus for and a method of controlling a water flow in a washer, capable of generating a drive pattern of an agitator of the washer by utilizing a branching phenomenon occurring in solutions of a function having one parameter, thereby considerably reducing a twist of clothes and improving a washed degree of the clothes.

In accordance with one aspect, the present invention provides an apparatus for controlling a water flow in a washer comprising: a washing tub in which clothes to be washed and a washing water are contained; a drive pattern generating unit for generating various drive patterns by use of a branching phenomenon occurring in solutions of a function having one parameter and outputting a drive pattern selected from said drive patterns by a user's selection; a motor rotating according to said selected drive pattern fed from said drive pattern generating unit; and an agitator rotating according to a rotation force and a rotation direction transmitted from said motor via a clutch adapted to transmit a rotation force of the motor, said agitator generating a flow of said washing water while rotating.

In accordance with another aspect, the present invention provides a method for controlling a water flow in a washer comprising the steps of: (a) predetermining the number of times (N) operating solutions of a function having one parameter until solutions periodically repeated are obtained from the function, an initial value of the function, a parameter of the function determined according to an operation mode selected by a user, the total number of solutions of the function repeatedly obtained for the determined parameter, and the number of times (I) executing drive patterns generated according to the solutions periodically obtained from the function for a predetermined washing operation time; (b) inputting said initial value of the function as a variable of the function, inputting said parameter determined according to said selected operation mode, deriving a solution of the function, based on the inputted initial value and parameter, inputting said solution of the function as the variable of the function to derive a solution of the function, and then repeatedly executing the above operation procedure of this step for the number of times (N) predetermined at said step (a); (c) executing the operation procedure of said step (b) again after execution of the step (b), generating a drive pattern for rotating an agitator equipped in said washer according to a rotation force and a rotation direction corresponding to a solution of the function obtained in the above operation procedure in this step, and then repeatedly executing the above procedure of this step for the predetermined total number of solutions; and (d) repeatedly executing the above procedures following the step (a) for the number of times (I) predetermined at the step (a) until the predetermined washing operation time elapses.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
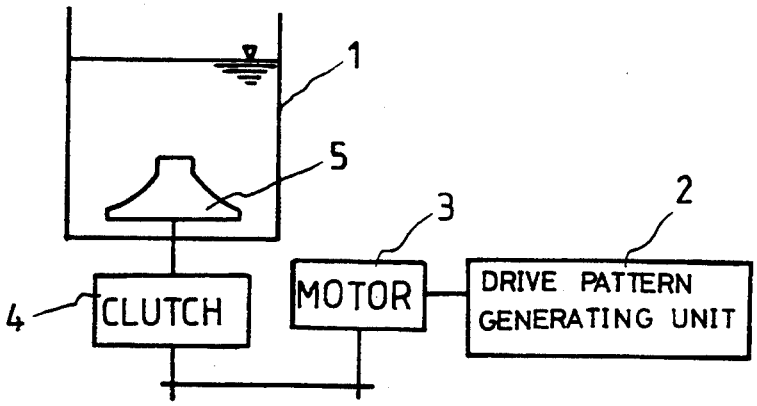
FIG. 1 is a block diagram illustrating an apparatus for controlling a water flow in a washer in accordance with the present invention.

FIG. 1 is a block diagram illustrating an apparatus for controlling a water flow in a washer in accordance with the present invention. As shown in FIG. 1, the washer includes a washing tub 1 in which clothes to be washed and washing water are contained. In accordance with the present invention, the control apparatus comprises a drive pattern generating unit 2 for generating a plurality of drive patterns by use of a branching phenomenon occurring in solutions of a function having one parameter and outputting a drive pattern selected from the generated drive patterns by a user's selection. A motor 3 is connected to the drive pattern generating unit 2. The motor 3 is driven according to the selected drive pattern fed from the drive pattern generating unit 2. To the motor 3, an agitator 5 is connected via a clutch 4. The agitator 5 rotates according to a rotation force and a rotation direction transmitted from the motor 3 via the clutch 4 and thereby generates a flow of the washing water.

Figure 6:
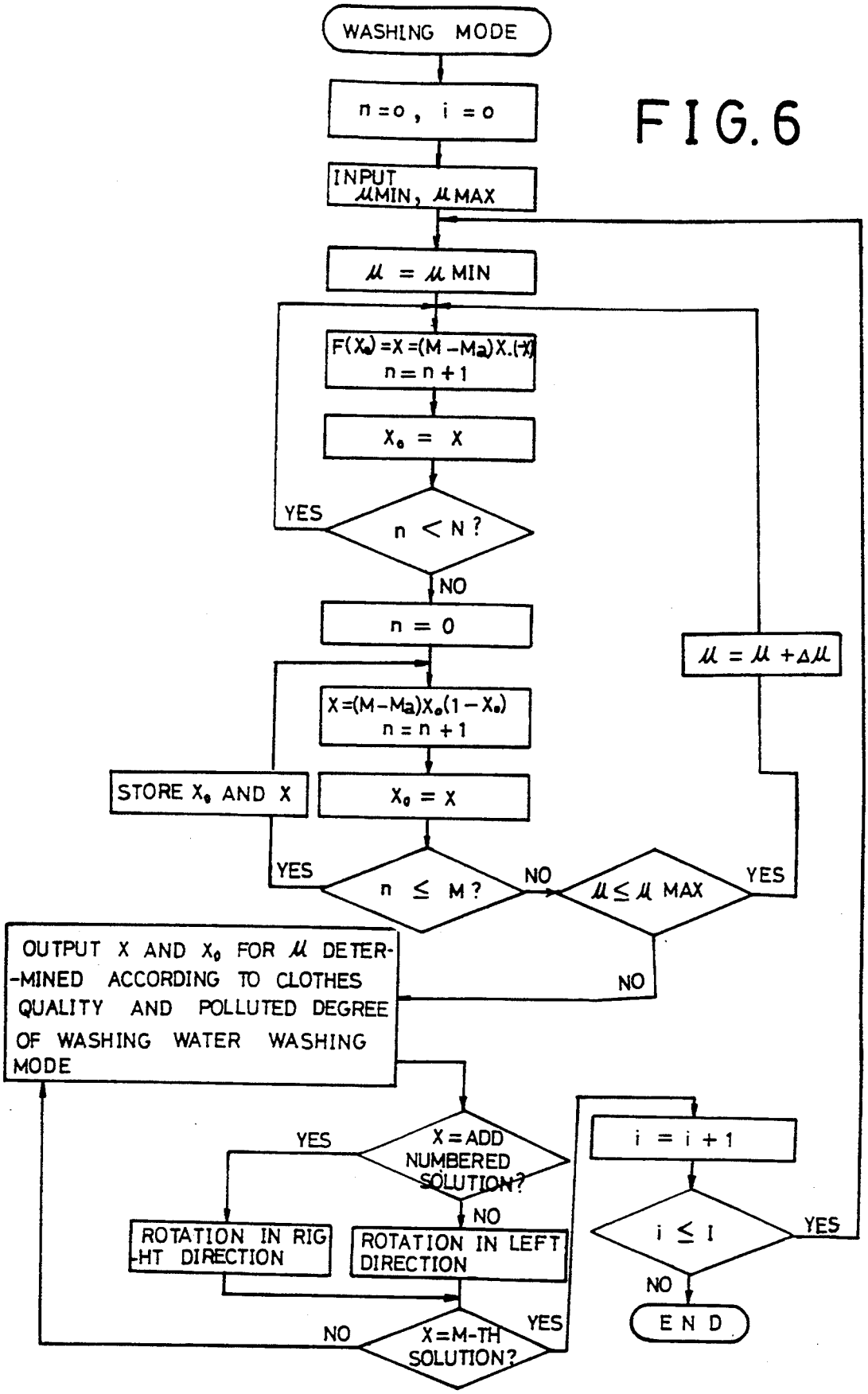
FIG. 6 is a flow chart illustrating the water flow controlling method in accordance with the present invention.

FIG. 6 is a flow chart illustrating a method for controlling a water flow in the washer shown in FIG. 1 in accordance with the present invention. As shown in FIG. 6, the controlling method comprises a first step of predetermining the number of times N operating solutions of a function G(x) having one parameter until solutions periodically repeated are obtained from the function G(.x), an initial value X0 of the function G(x), a parameter $\mu$ of the function G(x) determined according to an operation mode selected by a user, the total number of solutions M of the function G(x) repeatedly obtained for the determined parameter $\mu$, and the number of times I executing drive patterns generated according to the solutions periodically obtained from the function G(x) for a predetermined washing operation time. Thereafter, a second step is carried out which is of inputting the initial value X0 of the function G(x) as a variable of the function G(x), inputting the parameter $\mu$ determined according to the selected operation mode, deriving a solution of the function G(x), based on the inputted initial value X0 and parameter $\mu$, inputting the solution of the function G(x) as the variable of the function G(x) to derive a solution of the function G(x), and then repeatedly executing the above operation procedure of this step for the number of times (N) predetermined at the first step. The controlling method further comprises a third step of executing the operation procedure of the second step again after execution of the second step, generating a drive pattern for rotating the agitator 5 by a rotation force corresponding to a solution of the function G(x) obtained in the operation procedure, in right direction when the obtained solution is an odd-numbered solution and in left direction when the obtained solution is an even-numbered solution, and then repeatedly executing the above procedure of this step for the predetermined total number of solutions. Finally, a fourth step is carried out which is of repeatedly executing the above procedures following the first step for the number of times I predetermined at the first step until the predetermined washing operation time elapses.

Operation of the control apparatus and procedures of the control method in accordance with the present invention will now be described in conjunction with FIGS. 1 to 6.

A procedure of generating the agitator drive pattern in accordance with the present invention will be described, conjunction with an example in which a function G(x) ($G(x)=\mu x(1-x)$) that is a simple one of functions having one parameter is utilized.

Figure 2:
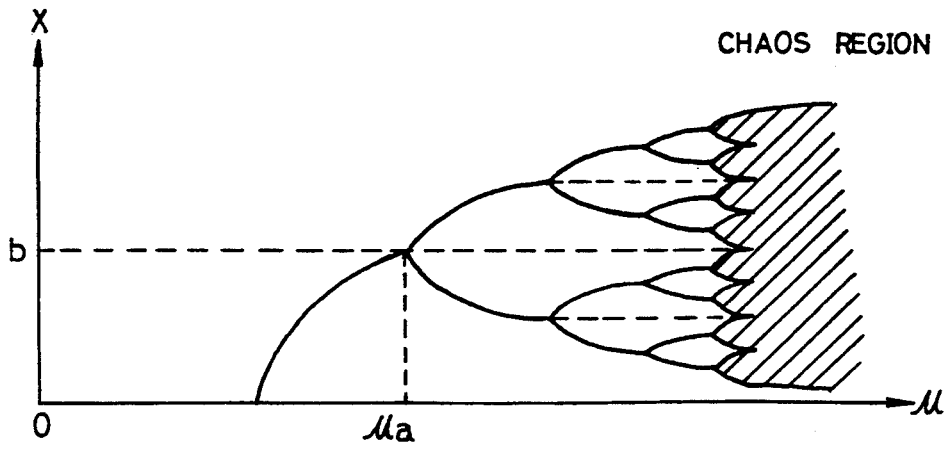
FIG. 2 is a diagram illustrating a branching phenomenon in solutions of a general function having one parameter.
Figure 3:
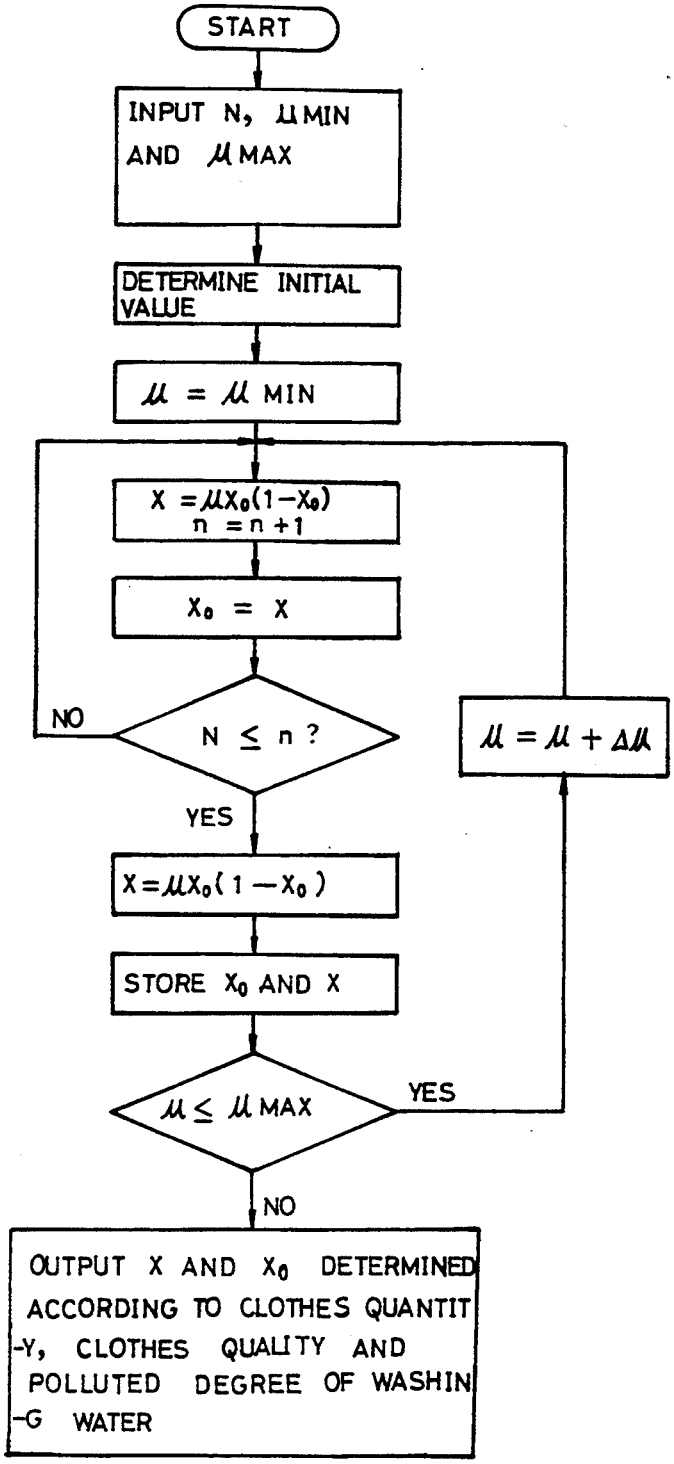
FIG. 3 is a flow chart illustrating a procedure of generating drive patterns by utilizing the branching phenomenon of the function shown in FIG. 2.

First, an initial value X0 of the function F(x) is inputted as a variable of the function F(x) so as to derive a solution X1 of the function F(x). The solution X1 is then inputted as the variable of the function F(x) so as to derive a solution of the function F(x). As these operations are repeated, the function F(x) have solutions of 2 values, 4 values or 8 values repeatedly derived depending on the parameter $\mu$, as shown in FIG. 2. For an optional parameter, each solution of the function F(x) exhibits a branching phenomenon. For instance, with respect to an optional parameter $\mu$a, two solutions of the function F(x) are branched into four solutions, as shown in FIG. 2. For an optional parameter $\mu$b, four solutions are branched into eight solutions. As the parameter p is continuously incremented, random solutions not beyond a certain boundary region are repeatedly obtained. This boundary region is called a chaos region.

Utilizing such a branch phenomenon of the function F(x), a generation of a drive pattern for the agitator is achieved. When the user selects a desired operation mode, a parameter $\mu$ is determined which corresponds to the selected operation mode.

For instance, assuming that an A mode and an auto mode have been selected by the user, the parameter $\mu$ is determined to have a minimum value $\mu$min of $\mu$a and a maximum value $\mu$max of $\mu$b. The initial value X0 of the function F(x) is also determined. The number of times N operating solutions of the function F(x) until solutions periodically repeated are obtained from the function F(x) is also determined.

Thereafter, the parameter value $\mu$a is inputted as the parameter of the function F(x). Also, the initial value X0 of the function F(x) is inputted as a variable of the function F(x), thereby deriving a solution of the function F(x). The derived solution is then inputted as the variable of the function F(x) so as to derive a solution of the function F(x) again. As these operations are repeated until the predetermined number of operation times N, two solutions of the function F(x) are repeatedly obtained. These two solutions are then stored.

Then, the above-mentioned operation procedure is carried out under a condition that the parameter $\mu$ is incremented by a predetermined value $\Delta\mu$. In this procedure, two solutions are also repeatedly obtained and then stored.

Figure 4A:
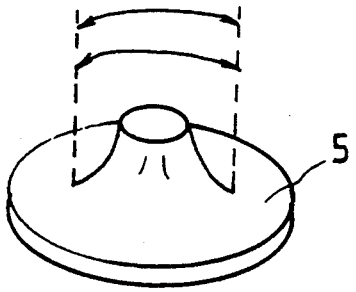
FIGS. 4A to 4D are schematic sectional views illustrating driving states, of an agitator according to various drive patterns generated in selected operation modes in accordance with the present invention, respectively.
Figure 4B:
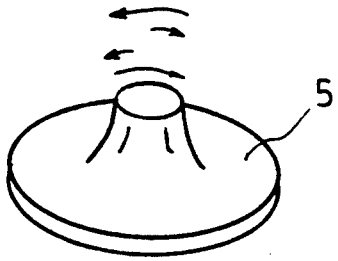

These procedures are repeated until the parameter $\mu$ corresponds to the maximum value $\mu$max. From the stored solutions, those selected according to a clothes quantity, a clothes quality and a polluted degree of washing water are outputted. As a result, the agitator is driven according to a rotation force and a rotation direction corresponding to each of the solutions outputted.

Where an A-strong mode is selected by the user, solutions of the function F(x) are derived with respect to the maximum parameter value $\mu$max so as to drive the agitator according to a rotation force and a rotation direction which correspond to each of the solutions. The agitator rotates in right and left direction respectively determined according to odd-numbered and even-numbered solutions, as shown in FIG. 4A.

In other words, the first solution X1 of the function F(x) derived with respect to the maximum parameter value $\mu$max is an odd-numbered solution. Accordingly, the agitator rotates in right direction by a rotation force corresponding to a value of the solution X1. On the other hand, the second solution X2 which is derived by inputting the odd-numbered solution X1 as a variable of the function F(x) becomes an even-numbered solution. As a result, the agitator rotates in left direction by a rotation force corresponding to a value of the solution X2.

On the other hand, where the user selects a B mode, the agitator rotates according to a rotation force and a rotation direction respectively corresponding to the value and the number of each of solutions of the function F(x) in a manner as mentioned above, as shown in FIG. 4B. In other words, the agitator initially rotates in right direction by a rotation force corresponding to an odd-numbered solution X3 of the function F(x). Then, the agitator rotates in left direction by a rotation force corresponding to an even-numbered solution X4 of the function F(x) obtained by inputting the odd-numbered solution X3 as a variable of the function F(x). The solution X4 is then inputted as the variable of the function F(x) so as to derive a solution X5 of the function F(x) which is, in turn, used to drive the agitator in right direction by a rotation force corresponding thereto.

Subsequently, the agitator rotates in left direction by a rotation force corresponding to a solution X6 of the function F(x) obtained by inputting the solution X5 as the variable of the function F(x).

However, where the above-mentioned principle of the present invention is practically applied to an agitator of a washer, an actual branching phenomenon occurring in solutions of a function having one parameter is more or less different from the above-mentioned branching phenomenon illustrated in the diagram of FIG. 2. Accordingly, the diagram of FIG. 2 is required to be modified into a diagram of FIG. 5. In other words, the parameter function F(x) is required to be modified into a function G(x) which satisfies the following equation:

$$G(x)=(\mu-\mu a)\times(1-x)+K$$

wherein, K represents a constant.

Figure 5:
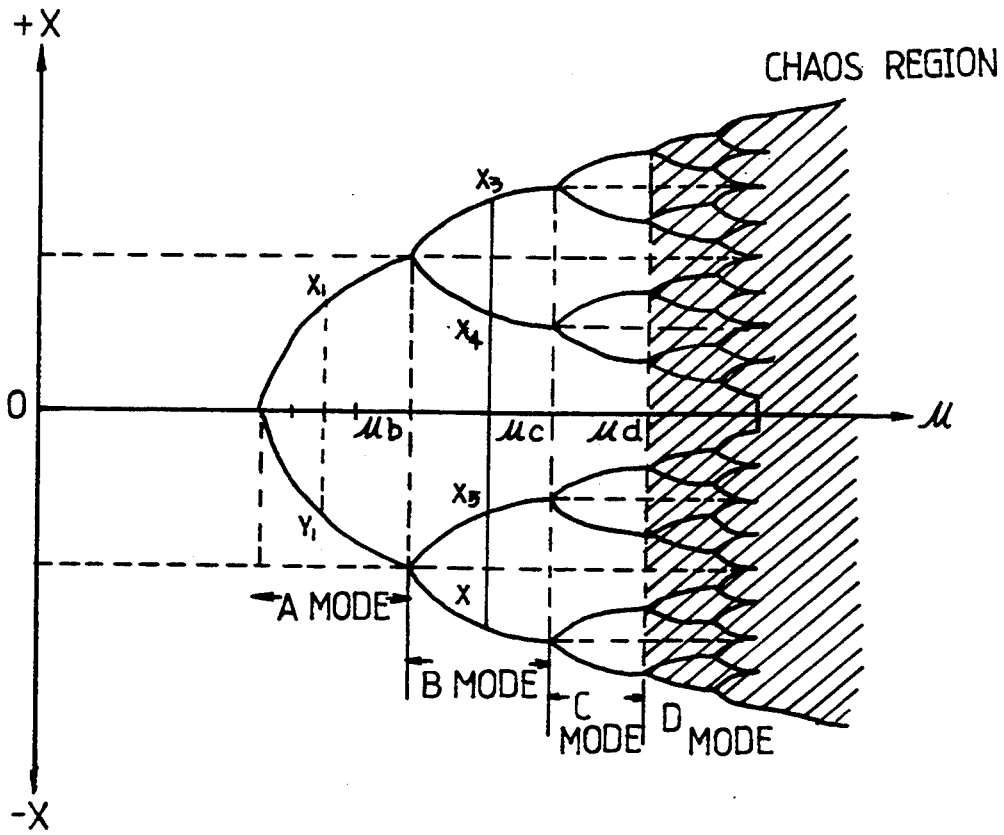
FIG. 5 is a diagram illustrating a branching phenomenon in solutions of a function which is applied to an apparatus of controlling a water flow in a washer in accordance with the present invention.

FIG. 5 is a diagram illustrating a solution branch phenomenon occurring in the function G(x).

A procedure of generating drive patterns for the agitator of the washer by utilizing the solution branch phenomenon occurring in the function G(x) will now be described in detail, in conjunction with FIGS. 5 and 6. First, an initial value X0 is predetermined. The number of times N operating solutions of the function G(x) until solutions periodically repeated are obtained from the function G(x) is also predetermined. Then, a solution of the function G(x) is derived by inputting the initial value X0 as a variable of the function G(x).

The derived solution is then inputted as the variable of the function G(x) so as to derive a solution of the function G(x). As the above operation procedure is repeated for the predetermined number of operation times N, the function G(x) have solutions of 2 values, 4 values or 8 values repeatedly derived depending on the parameter $\mu$, as shown in FIG. 5. For an optional parameter $\mu a$, two solutions of the function G(x) are branched into four solutions. For an optional parameter $\mu b$, four solutions are branched into eight solutions. As the parameter $\mu$ is continuously incremented, random solutions not beyond a certain boundary region are repeatedly obtained.

Utilizing such a branch phenomenon of the function G(x), a generation of agitator drive patterns is achieved. When the user selects a desired operation mode, a parameter $\mu$ is determined which corresponds to the selected operation mode.

For instance, assuming that an A mode and an auto mode have been selected by the user, the parameter $\mu$ is determined to have a minimum value $\mu min$ of $\mu a$ and a maximum value $\mu max$ of $\mu b$. Also determined are the total number of solutions M (M=2) of the function G(x) determined by the parameter $\mu$ for the A mode selected by the user and the number of times I using drive patterns generated according to solutions periodically obtained from the function G(x) for a predetermined washing operation time.

Thereafter, the parameter value $\mu a$ is inputted as the parameter of the function G(x). Also, the initial value X0 of the function G(x) is inputted as a variable of the function G(x), thereby deriving a solution of the function G(x). The derived solution is then inputted as the variable of the function G(x) so as to derive a solution of the function G(x) again. As these operations are repeated until the predetermined number of operation times N, two solutions X1 and X2 (M=2) of the function G(x) are repeatedly obtained. These two solutions X1 and X2 are then stored.

Then, the above operation procedure is carried out under a condition that the parameter $\mu$ is incremented by a predetermined increment $\Delta\mu$. In this procedure, two solutions are also repeatedly obtained and then stored.

These procedures are repeated until the parameter $\mu$ corresponds to the maximum value $\mu max$. From the stored solutions, those selected according to a clothes quantity, a clothes quality and a polluted degree of washing water are outputted. As a result, the agitator is driven according to a rotation force and a rotation direction corresponding to each of the solutions outputted.

Where an A-strong mode is selected by the user, solutions X1 and X2 of the function G(x) are derived with respect to the maximum parameter value $\mu max$ so as to drive the agitator according to a rotation force and a rotation direction which correspond respectively to the value and the number of each of the solutions X1 and X2.

In other words, the first solution X1 of the function G(x) derived with respect to the maximum parameter value $\mu max$ is an odd-numbered solution. Accordingly, the agitator rotates in right direction by a rotation force corresponding to a value of the solution X1. On the other hand, the second solution X2 which is derived by inputting the odd-numbered solution X1 as a variable of the function G(x) becomes an even-numbered solution. As a result, the agitator rotates in left direction by a rotation force corresponding to a value of the solution X2.

On the other hand, where the user selects a B mode, the agitator rotates according to a rotation force and a rotation direction respectively corresponding to the value and the number of each of solutions of the function G(x) in a manner as mentioned above. In other words, the agitator initially rotates in right direction by a rotation force corresponding to an odd-numbered solution X3 of the function G(x). Then, the agitator rotates in left direction by a rotation force corresponding to an even-numbered solution X4 of the function G(x) obtained by inputting the odd-numbered solution X3 as a variable of the function G(x). The solution X4 is then inputted as the variable of the function G(x) so as to derive a solution X5 of the function G(x) which is, in turn, used to drive the agitator in right direction by a rotation force corresponding thereto, Subsequently, the agitator rotates in left direct, ion by a rotation force corresponding to a solution X6 of the function G(x) obtained by inputting the solution X5 as the variable of the function G(x).

By the drive patterns continuously generated in a manner as mentioned above, driving of the agitator is continuously controlled for the predetermined number of times I.

Although the rotation direction of the agitator has been described as being determined by determining whether each solution derived bears an odd number or an even number, it may be determined by determining whether each solution bears a positive value or a negative value.

In this case, if the user selects the B mode, the agitator rotates according to a rotation force and a rotation direction respectively corresponding to the value and the polarity of each of solutions of the function G(x). In other words, the agitator initially rotates in right direction by a rotation force corresponding to a positive solution X3 of the function G(x). Then, the agitator further rotates in right direction by a formation force corresponding also a positive solution X4 of the function G(x) obtained by inputting the solution X3 as a variable of the function G(x). The solution X4 is then inputted as the variable of the function G(x) so as to derive a solution X5 of the function G(x). The solution X5 has a negative value and thus drive the agitator in left direction by a rotation force corresponding thereto. Subsequently, the agitator further rotates in left direction by a rotation force corresponding to a negative solution X6 of the function G(x) obtained by inputting the negative solution X5 as the variable of the function G(x).

Figure 4C:
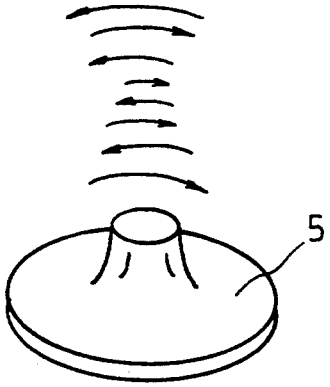
Figure 4D:
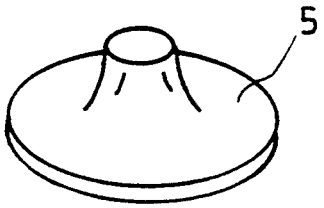

When a C mode is selected by the user, the total number of solutions M of the function G(x) is 8. In this case, driving of the agitator is controlled, based on 8 drive patterns respectively corresponding to the 8 solutions, as shown in FIG. 4C.

As the agitator is driven according to the drive patterns generated as mentioned above, a washing force obtained by the agitator is improved. Where clothes being washed are large in quantity, however, twist of clothes may occur.

Such a problem occurring when clothes being washed are large in quantity may be solved by selecting a D mode corresponding to the chaos region, in accordance with the present invention. Where the user selects the E mode, random and unpredictable solutions not beyond a certain boundary value are obtained from the function G(x). Based on such random solutions, the agitator is driven at short time intervals, thereby generating random water flows. Such random water flows serve to considerably reduce the twist of clothes and thus improve the washing efficiency.

As apparent from the above description, the present invention provides an apparatus for and a method of controlling a water flow in a washer, capable of generating drive patterns for an agitator of the washer by utilizing a branching phenomenon occurring in solutions of a function having one parameter, thereby considerably reducing a twist of clothes and preventing a decrease in washing force. In accordance with the present invention, it is possible to eliminate use of an additional clothes untwisting operation mode and thus reduce a washing operation time.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a water flow in a washer comprising the steps of:

(a) inputting a parameter ($\mu$) corresponding to a mode selected by a user;

(b) calculating a function from an initial value (Xo) of a solution of a present function ($X=\mu Xo(1-Xo)$) and the parameter which has been inputted in step (a) and iteratively calculating a calculated value of the function by inputting the calculated value as a solution of the function until the value of the function is obtained repeatedly at a predetermined period;

(c) repeatedly calculating the value of the function as many times as a predetermined number (I) by inputting said value of the function as a solution of the function and outputting the value of the function; and (d) outputting a drive pattern of a motor of a washer, corresponding to the value of the function being repeatedly outputted in steps (c).

2. The method of claim 1, wherein a rotation force of said drive pattern of the motor of the washer generated in step (d) is determined by the magnitude of the function value outputted in step (c) and the rotational direction of the drive is determined based on whether said function value outputted in step (c) is an odd-numbered value or an even-numbered value.

3. The method of claim 1, wherein a rotation force of said drive pattern of the motor of the washer is determined by the magnitude of the washer is determined by the magnitude of the function value outputted in step (c) and the rotational direction of the drive pattern is determined based On whether the function value outputted in step (c) is a positive (+) value or a negative (−) value.

4. A method of controlling a water flow in a washer comprising the steps of:

(a) setting an initial value (Xo) of a solution of a function ($X=\mu Xo(1-Xo)$) and minimum and maximum values of a parameter and selecting a current parameter value as a minimum value;

(b) calculating a value of said function from the initial value and parameter value which have been set in step (a), and iteratively calculating the function value by inputting the calculated value as a solution of the function until the value of the function is obtained repeatedly at a predetermined period;

(c) calculating a value of said function as many times as a predetermined number (I) by inputting said value as a solution of said function and outputting said function value;

(d) repeatedly executing said steps (a), (b) and (c) until the minimum value of the parameter comes to the maximum value thereof by increasing the minimum value of the parameter as much as a predetermined level ($\Delta\mu$); and (e) generating a drive pattern of a motor of a washer corresponding to the function values repeatedly outputted in steps (c) and (d).

* * * * *